US005136488A

United States Patent [19]

McElwee

[11] Patent Number: 5,136,488

[45] Date of Patent: Aug. 4, 1992

[54] MULTI-DIRECTIONAL MINIATURE SWITCH INDICATOR LIGHT

[75] Inventor: James F. McElwee, Raleigh, N.C.

[73] Assignee: Square D Company, Palatine, Ill.

[21] Appl. No.: 636,052

[22] Filed: Dec. 31, 1990

[51] Int. Cl.[5] ..... F21V 33/00

[52] U.S. Cl. ..... 362/95; 362/802; 200/310

[58] Field of Search ..... 362/95, 801, 802, 800; 200/310, 317, 312, 313

[56] References Cited

U.S. PATENT DOCUMENTS

| | | | |
|---|---|---|---|
| 2,498,943 | 2/1950 | Courtney | 200/317 |
| 3,156,805 | 11/1964 | Baker et al. | 200/310 |
| 3,168,636 | 2/1965 | Smidt | 200/317 |
| 4,020,308 | 4/1977 | Edwards, Jr. et al. | 200/310 |
| 4,628,419 | 12/1986 | Schmid | 362/800 |
| 4,745,534 | 5/1988 | Brunner | 362/800 |

FOREIGN PATENT DOCUMENTS

| | | | |
|---|---|---|---|
| 2806338 | 8/1979 | Fed. Rep. of Germany | 200/310 |
| 2105911 | 3/1983 | United Kingdom | 200/310 |

OTHER PUBLICATIONS

General Electric Brochure CR 103 Type C Square Indicating Lights Feb. 10, 1965.

*Primary Examiner*—Ira S. Lazarus
*Assistant Examiner*—Sue Hagarman
*Attorney, Agent, or Firm*—Michael J. Femal; Larry T. Shrout

[57] ABSTRACT

A stackable multi-directional indicator light for displaying the ON/OFF status of a miniature switch such as a limit or stackable switch. The miniature switch includes a switch mechanism for making and breaking an electrical circuit, an actuator for actuating the switch, and a wiring cable for providing the electrical circuit. The multi-directional indicator light includes an indicator light source connected to the switch mechanism, and a cover/lens for displaying light emitted from the indicator light when the switch is in the ON state. The indicator light is mounted in the cover/lens which is made from a light transmissive material. The switch mechanism, indicator light source, and cover/lens are mounted on a base made from a material of suitable strength to provide support and protection. The base and cover/lens provide physical protection for the indicator light and the switch mechanism. The base also includes a passage for retaining the actuator and permitting it to communicate with the switch mechanism.

12 Claims, 5 Drawing Sheets

MULTI-DIRECTIONAL MINIATURE SWITCH INDICATOR LIGHT

FIELD OF THE INVENTION

This invention relates to a visual indicator for displaying the ON-OFF state of miniature limit switches or miniature switches of the type that may be stacked or ganged together to form a sandwich of switches. More precisely, the present invention relates to visual indication of the ON-OFF state of the switch by using a light source which may be seen from at least three sides of the switch at all times.

BACKGROUND OF THE INVENTION

Previous miniature switches of the type indicated having indicator lights were designed such that the indicator light was visible from a very limited area.

SUMMARY OF THE INVENTION

The indicator light of the present invention is always visible from at least three sides of the switch and may be visible from five sides when the switches are not stacked or ganged together. The indicator of the present invention is an integral part of the switch enclosure thereby eliminating the need for light bulbs or other indicating methods protruding from the surface of the switch.

Other features and advantages of the invention will become apparent to those skilled in the art upon review of the following detailed description, claims and drawings.

Other features and advantages of the invention will become apparent to those skilled in the art upon review of the following detailed description, claims and drawings.

Figure 1:
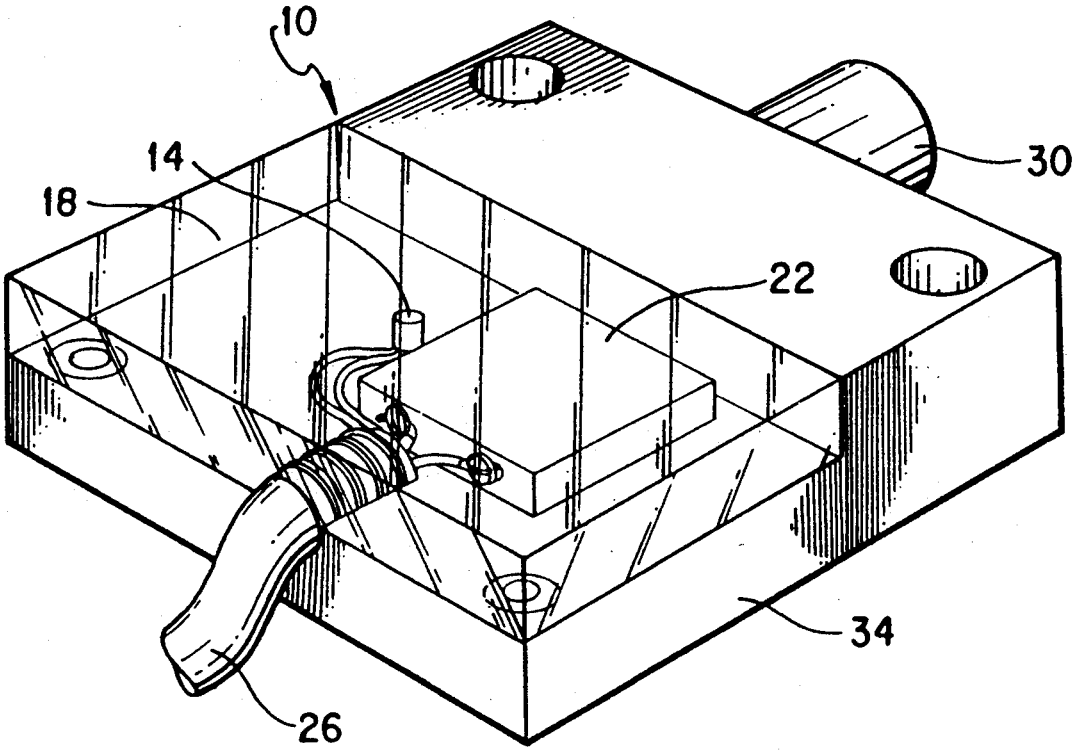
FIG. 1 shows an assembled miniature limit switch having a multi-directional indicator light.

Before one embodiment of the invention is explained in detail, it is to be understood that the invention is not limited in its application to the details of construction and description or illustrated in the drawings. The invention is capable of other embodiments and of being practiced or being carried out in various other ways. Also, it is to be understood that the phraseology and terminology used herein is for the purpose of description and should not be regarded as limiting.

DESCRIPTION OF THE PREFERRED EMBODIMENT

The stackable miniature limit switch 10 shown in FIG. 1 has an indicator light source 14 which may be viewed from at least three directions through a cover/lense 18. The limit switch 10 also includes a switch mechanism 22 which makes and breaks an electrical circuit provided by a wiring cable 26 in response to movement of an actuator 30. A base 34 supports the indicator light 14, the cover/lense 18, the switch mechanism 22, and the actuator 30.

Figure 2:
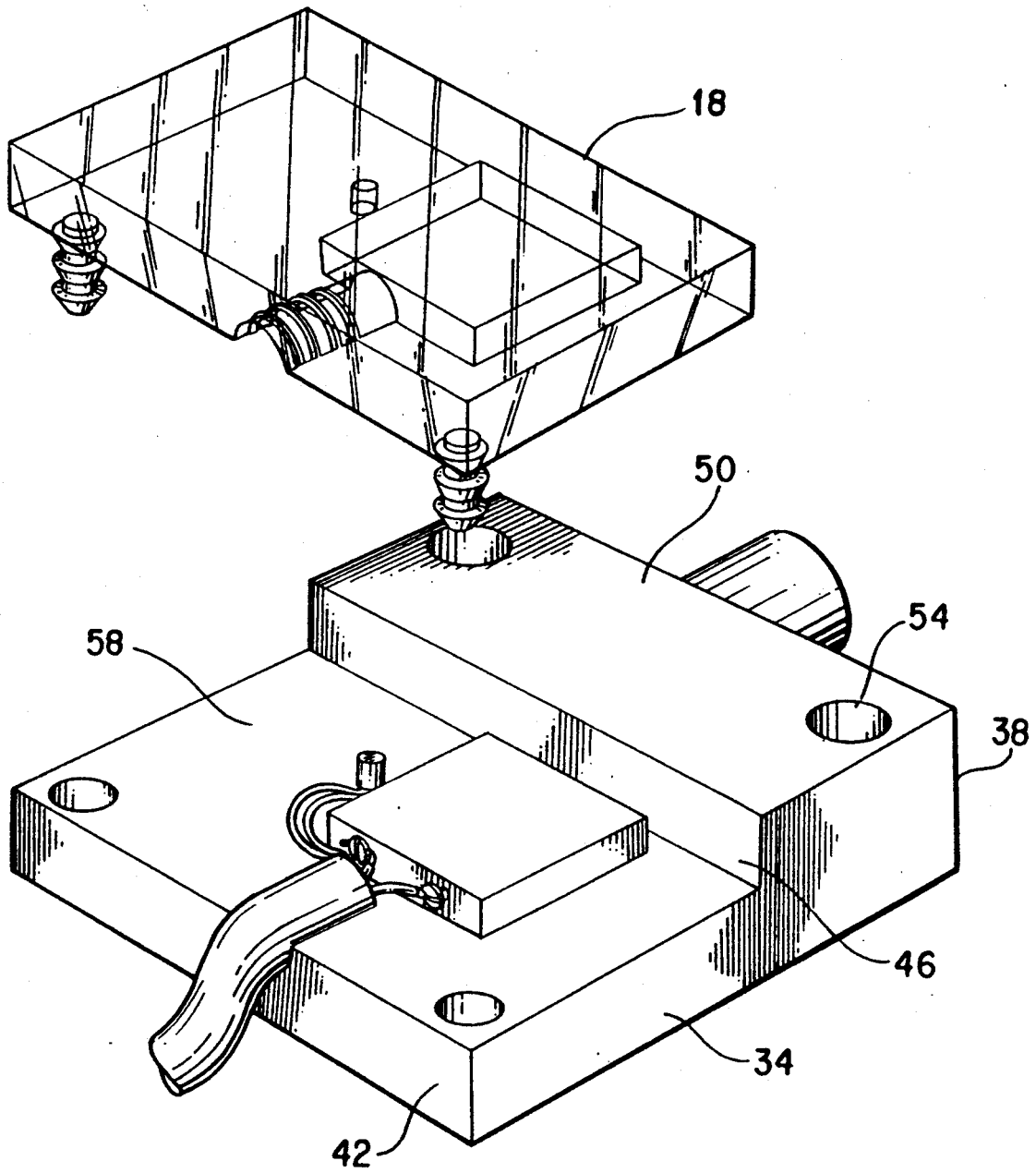
FIG. 2 shows the base sub assembly of a miniature limit switch having a multi-directional indicator light.
Figure 3:
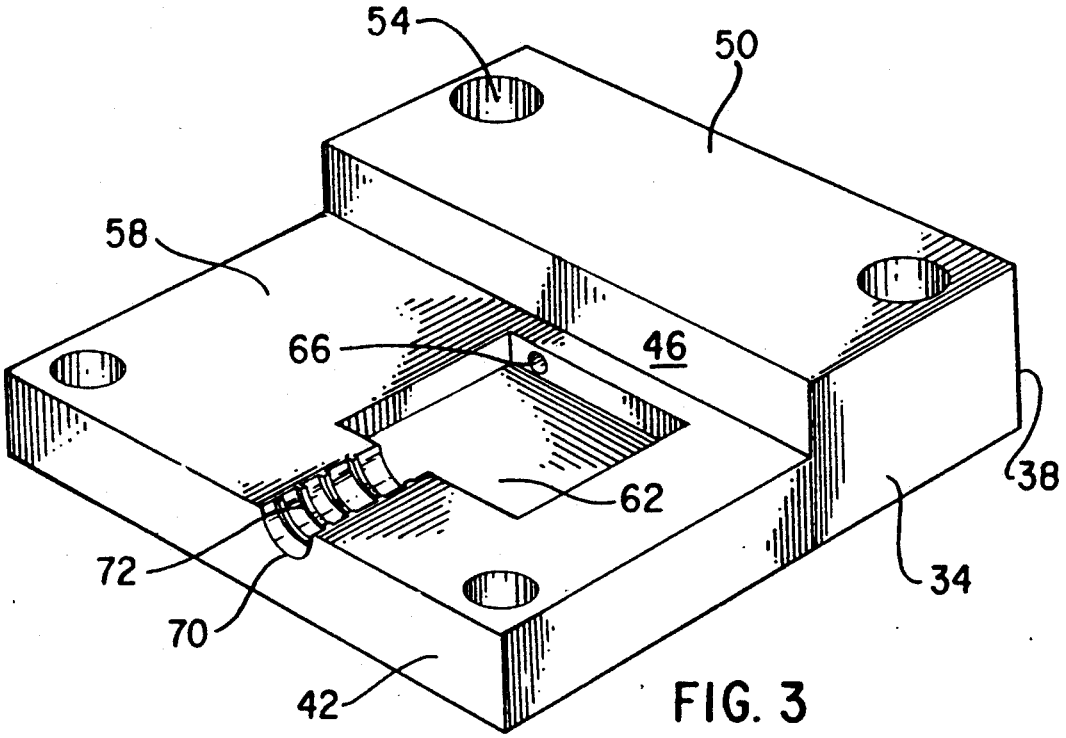
FIG. 3 shows a miniature limit switch base.

As shown in FIGS. 2 and 3, the base 34 is generally rectangular in shape and has an L-shaped cross-section. The base 34 includes a first end 38, generally equivalent to the short leg of the L-shaped cross section, and a second end 42, generally equivalent to the top of the long leg of the L-shaped cross section and parallel to the first end 38. Both the first and second ends 38 and 42, respectively, are rectangular in shape with the second end 42 being approximately one-half the height of the first end 38. The first end 38 also includes an inside surface 46. A mounting pad 50, generally rectangular in shape, is located between the first end 42 and its inside surface 46. The mounting pad 50 includes apertures 54 for accepting mounting screws. The base 34 has an inside surface 58 which is stepped down from the mounting pad 50 and extend between the second end 42 and the inside surface 46 of the first end 38. The inside surface 58 has a rectangular recess 62 for receiving approximately one half of the switch mechanism 18. A passage 66 connects the first end 38 with the rectangular recess 62 and receives the actuator 30. The actuator 30 is movable between an extended position and a retracted position and is biased to the extended position. When the actuator 30 moves between its extended and retracted positions it activates the switch mechanism 22 causing the switch mechanism 22 to change its state from ON to OFF or OFF to ON. The indicator light source 14 is electrically connected to the switch mechanism 22 such that it visually displays the ON state by emitting light and the OFF state by not emitting light. A semi-circular groove 70 is located generally to one side of the center line of the inside surface 58. The groove 70 provides approximately one half of a passage required for the wiring cable 26 to pass from the second end 42 into the rectangular recess 62. The groove 70 includes a number of parallel ridges 72 which extend into the passage such that they press against the wiring cable 26 preventing it from being removed from the switch 10. The ridges 72 are spaced apart one from another and perpendicular to the longitudinal axis of the groove 70. The base 34 is made from a material of sufficient strength to support and protect the light source 14, cover/lense 18, switch mechanism 22 and actuator 30.

Figure 4:
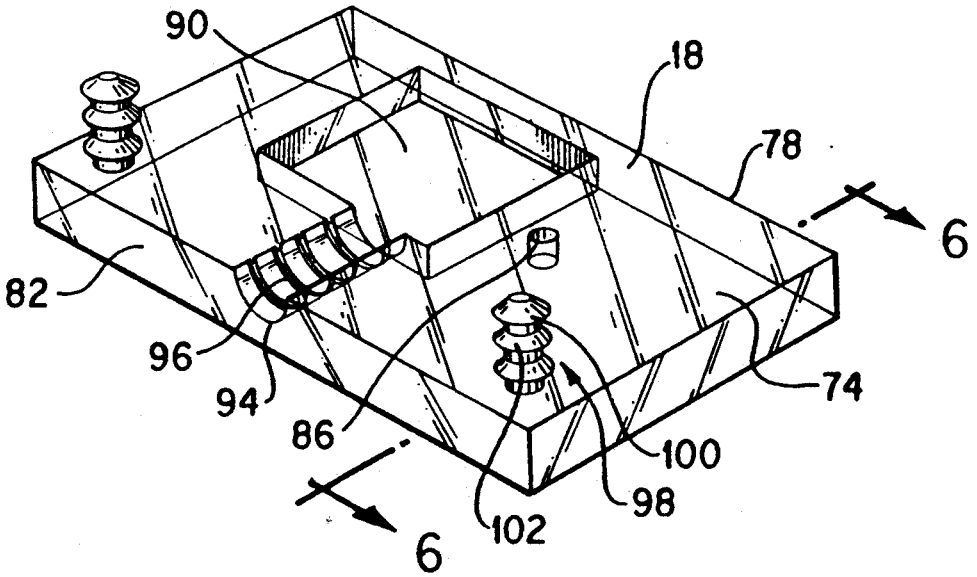
FIG. 4 shows an inside view of the cover/lense.

The cover/lense 18 as shown in FIG. 4 is square in shape and is made of a light transmissive material such that light may be transmitted through it. The cover/lense 18 includes an inside surface 74, a first end 78, and a second end 82. The indicator light 14 is mounted in an aperture 86 located on the inside surface 74 of the cover/lense 18 near the center line of the cover/lense 18. The light transmissive quality of the cover/lense 18 to function as the display for the indicator light source 14. The inside surface 74 also includes a rectangular recess 90 for receiving approximately one half of the switch mechanism 22. A semi-circular groove 94 located generally to one side of the center line of the inside surface 82 provides approximately one half of a passage for the wiring cable 26 to pass from the second end 82 to the rectangular recess 90. The groove 94 includes a number of parallel ridges 96 which are perpendicular to the longitudinal axis of the groove 94 and extend into the passage such that they press against the wiring cable 26 preventing it from being removed from the switch 10.

Figure 6:
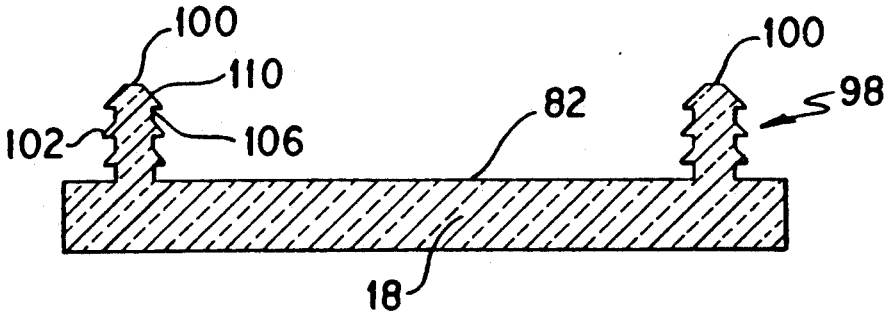
FIG. 6 shows a cross-sectional view taken along line 6—6 of FIG. 4.

Projections 98 as shown in FIG. 6 extend perpendicularly from the inside surface 82 of the cover/lense 18 and terminate in an extended end 100. Each projection 98 has a number of barb-like rings 102 extending radially from the projection 98. Each ring 102 is an integral part of the projection 98 and as a wedge-shaped cross section. The rings 102 are spaced apart one from another along the length of the projection 98. The wedge-shaped cross section of each ring 102 is such that a first surface 106 extends perpendicular to the projection 98 and a second surface 110 forms an obtuse angle with the projection 98. The obtuse angle of the second surface 110 permits the projection 98 to be pressed into a hole having a diameter slightly smaller than the diameter of the rings 102. The first surface 106 prevents the projection 98 from being removed from the hole. Other embodiments could include other forms of snap connections or a hole for permitting a screw or rivit to pass through.

Figure 5:
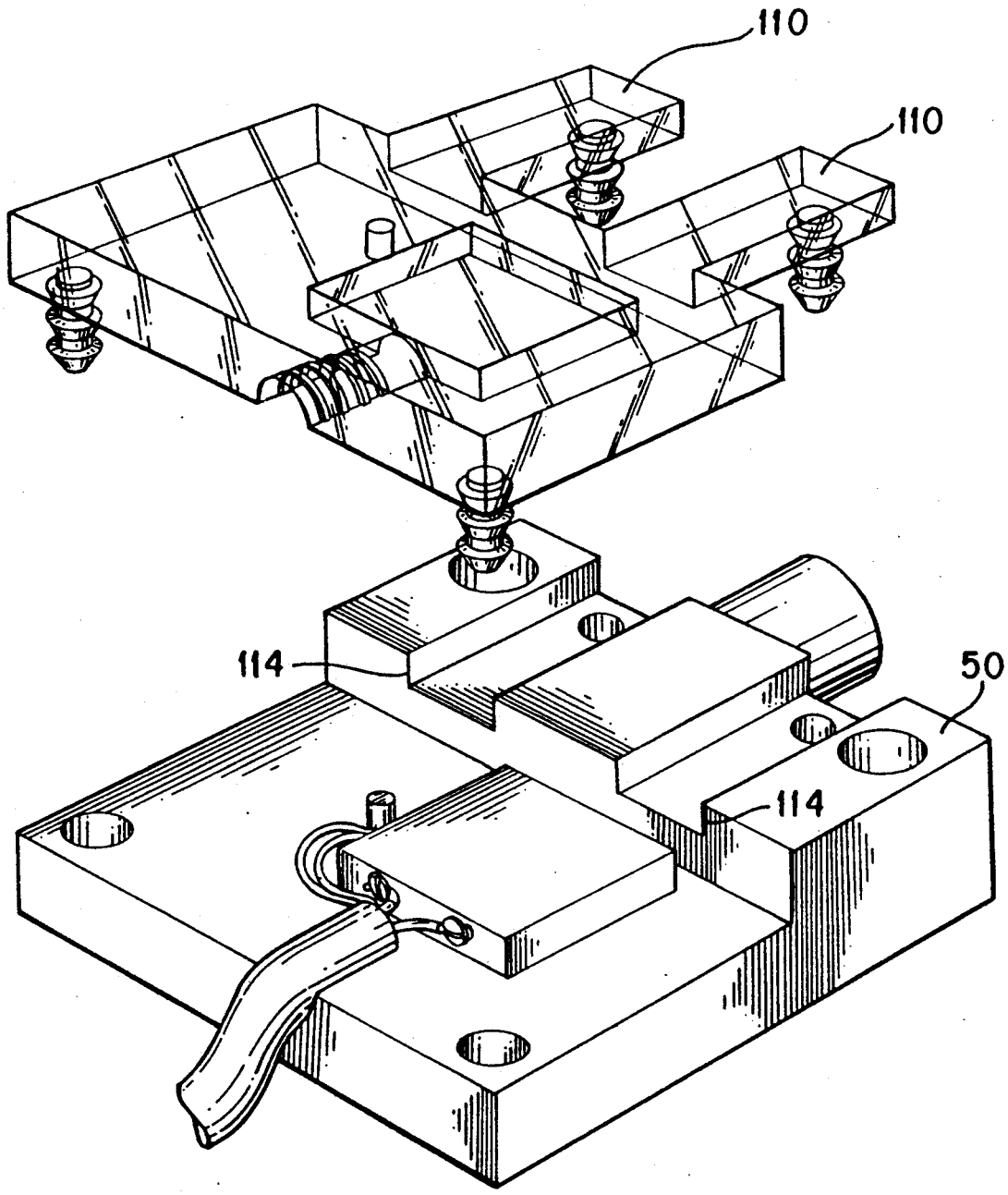
FIG. 5 shows an exploded view of a switch with an alternate cover/lense design.

In another embodiment shown in FIG. 5, two parallel rectangular slots 114 extend across the mounting pad 50 connecting the first end 38. The cover/lense 18 has two parallel rectangular extensions 118 which are received in the rectangular slots 114 in order to provide an indicating light source visible from the first end 38 of the base 34.

Figure 7:
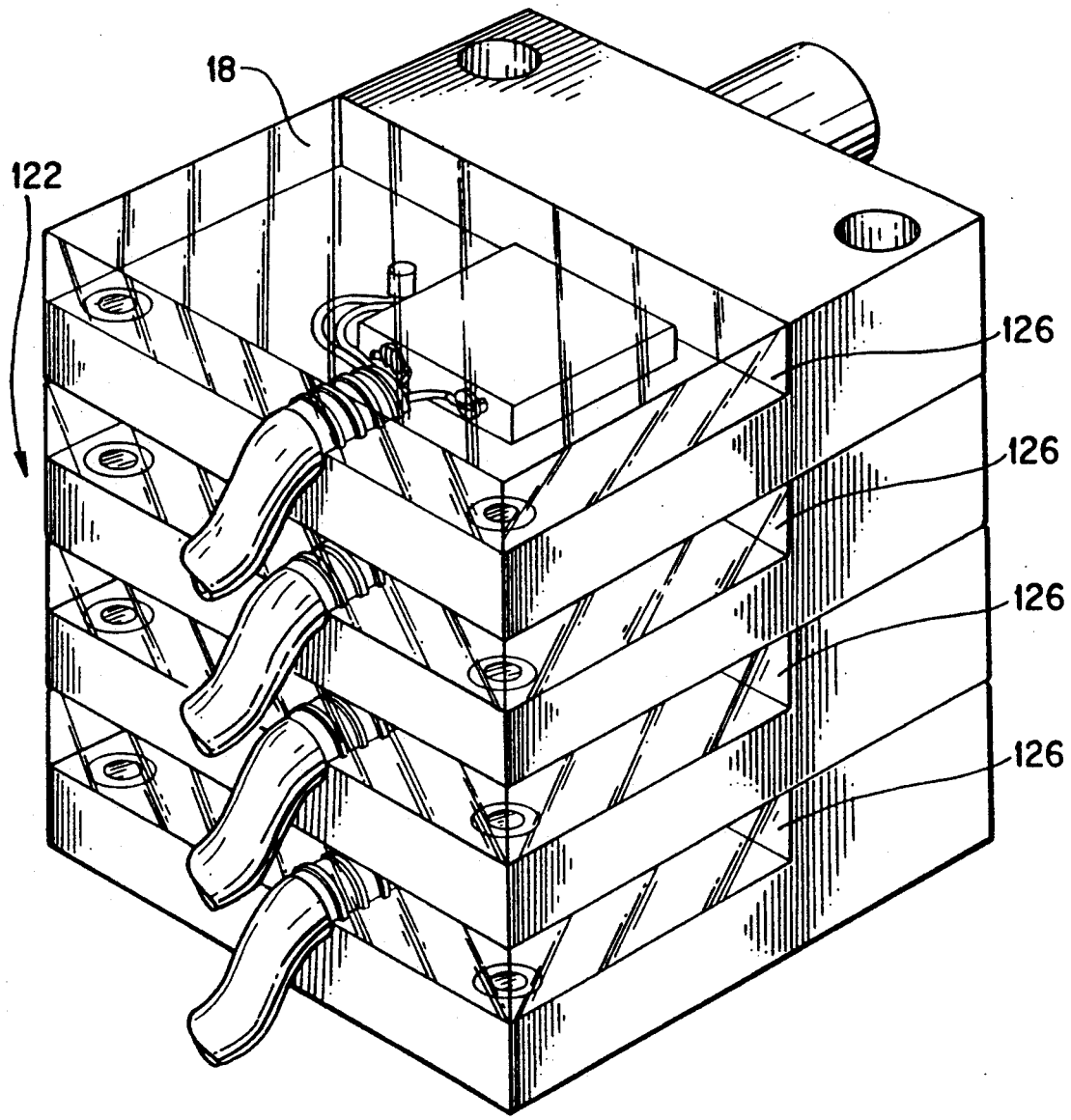
FIG. 7 shows a stack of limit switches sandwiched together.

In FIG. 7, a stack of limit switches 122 are sandwiched together. The edges 126 of each cover/lense 18 provide an indicator light for each of the limit switches 10.

I claim:

1. A stackable multi-direction indicator light for displaying the ON/OFF status of a miniature switch wherein the switch includes a switch mechanism, an actuator, and a wiring cable, said multi-directional indicator light comprising:

(a) a light source electrically connected to the switch mechanism for indicating the ON/OFF state of the switch mechanism;

(b) a translucent cover/lense, generally rectangular in shape, for protecting said light source and the switch mechanism from physical damage, and for displaying said light source;

(c) a base, generally rectangular in shape, on which the switch mechanism, said light source and said to cover/lense are mounted to form a stackable enclosure; and (d) means for attaching said translucent cover/lense to said base.

2. A stackable multi-direction indicator light in accordance with claim 1 wherein said base has an L-shaped cross section and further comprises:

(a) a first end generally rectangular in shape;

(b) a second end, generally rectangular in shape and parallel to said first end;

(c) a mounting pad generally rectangular in shape and adjacent said first end, said mounting pad includes apertures for accepting mounting hardware for stacking at least one additional miniature switch adjacent another one; and (d) an inside surface, generally rectangular in shape, said inside surface includes a generally rectangularly shaped recess located generally to one side of the center of said base, said recess for receiving a portion of the switch mechanisms, a passage communicating from said first end to said recess for receiving said actuator, and a semicircular groove extending from said second end inward to said recess, said groove forming one half of a passage for permitting the entrance of the wiring cable.

3. A stackable multi-direction indicator light in accordance with claim 2 wherein said semi-circular groove in said base further includes:

(a) a plurality of ridges being parallel to one another and perpendicular to the longitudinal axis of said groove, said ridges extending into said passage for retaining the wiring cable.

4. A stackable multi-direction indicator light in accordance with claim 1 wherein said cover/lense further comprises:

(a) a first end, generally rectangular in shape;

(b) a second end, generally rectangular in shape and parallel to said first end;

(c) an inside surface, said inside surface includes a cylindrically shaped aperture in about the center thereof and extending into said cover/lense, said aperture for receiving said indicator light source, a rectangular shaped recess located generally to one side of said cylindrical aperture, said recess for receiving a portion of the switch mechanism, and a semicircular groove extending from said second end inward to said recess for permitting the entrance of the wiring cable.

5. A stackable multi-direction indicator light in accordance with claim 4 wherein said semi-circular groove in said cover/lense further includes:

(a) a plurality of ridges being parallel to one another and perpendicular to the longitudinal axis of said groove, said ridges extending into said passage for retaining the wiring cable.

6. A stackable multi-direction indicator light in accordance with claim 1 wherein said means for attaching said cover/lense to said base further comprises:

(a) plurality of cylindrically shaped projections extending perpendicularly from said inside surface of said cover/lense, each said projection has an extended end and a plurality of barb-like rings extending radially from said projection, said rings each being integral with said projection and spaced apart from one another along its length, said rings having a wedge-shaped cross section such that a first surface of each said ring is perpendicular to said projection and a second surface of each said ring forms an obtuse angle with said projection with respect to said extended end of said projection, said projections are pressed into apertures located in said base and having a slightly smaller diameter than said rings.

7. A stackable multi-direction indicator light for displaying the ON/OFF status of a miniature switch wherein the switch includes a switch mechanism, an actuator, and a wiring cable, said multi-directional indicator light comprising:

(a) a light source electrically connected to the switch mechanism for indicating the ON/OFF state of the switch mechanism;

(b) a cover/lense for protecting said light source and the switch mechanism from physical damage, and for displaying said light source;

(c) a base, generally rectangular in shape, on which the switch mechanism, said light source and said cover/lense are mounted to form a stackable enclosure; and (d) means for attaching said cover/lense to said base.

8. A stackable multi-direction indicator light in accordance with claim 7 wherein said base has an L-shaped cross section and further comprises:

(a) a first end generally rectangular in shape and having an inside surface;

(b) a second end, generally rectangular in shape and parallel to said first end;

(c) a mounting pad generally rectangular in shape and adjacent said first end, said mounting pad includes an inside surface, a pair of rectangular slots extending across said mounting pad and connecting said first end of said base with said inside surface of said mounting pad and apertures for accepting mounting hardware; and (d) an inside surface, generally square in shape, said inside surface includes a rectangularly shaped recess located generally to one side of the center of said base, said recess for receiving a portion of the switch mechanisms, a passage communicating from said first end to said recess for receiving said actuator, and a semicircular groove extending from said second end inward to said recess for permitting the entrance of the wiring cable.

9. A stackable multi-direction indicator light in accordance with claim 8 wherein said semi-circular groove in said base further includes:

(a) a plurality of ridges being parallel to one another and perpendicular to the longitudinal axis of said groove, said ridges extending into said passage for retaining the wiring cable.

10. A stackable multi-direction indicator light in accordance with claim 7 wherein said cover/lense further comprises:

(a) a first end, generally rectangular in shape;

(b) a second end, generally rectangular in shape and parallel to said first end;

(c) a pair of rectangular extensions extending from said first end, said extensions are received in said slots of said mounting pad for transmitting light from said light source to said first end of said base; and (d) an inside surface, said inside surface includes a cylindrically shaped aperture in about the center thereof and extending into said cover/lense, said aperture for receiving said indicator light source, a rectangular shaped recess located generally to one side of said cylindrical aperture, said recess for receiving a portion of the switch mechanism, and a semicircular groove extending from said second end inward to said recess for permitting the entrance of the wiring cable.

11. A stackable multi-direction indicator light in accordance with claim 8 wherein said semi-circular groove in said base further includes:

(a) a plurality of ridges being parallel to one another and perpendicular to the longitudinal axis of said groove, said ridges extending into said passage for retaining the wiring cable.

12. A stackable multi-direction indicator light in accordance with claim 7 wherein said means for attaching said cover/lense to said base further comprises:

(a) plurality of cylindrically shaped projections extending perpendicularly from said inside surface of said cover/lense, each said projection has an extended end and a plurality of barb-like rings extending radially from said projection, said rings each being integral with said projection and spaced apart from one another along its length, said rings having a wedge-shaped cross section such that a first surface of each said ring is perpendicular to said projection and a second surface of each said ring forms an obtuse angle with said projection with respect to said extended end of said projection, said projections are pressed into apertures located in said base and having a slightly smaller diameter than said rings.

* * * * *